US006418769B1

(12) United States Patent
Schreiner

(10) Patent No.: US 6,418,769 B1
(45) Date of Patent: Jul. 16, 2002

(54) METHOD FOR QUALITY ASSURANCE OF CRIMP CONNECTIONS PRODUCED BY A CRIMPING DEVICE AND CRIMPING TOOL AND CRIMPING DEVICE THEREFOR

(75) Inventor: Lothar Schreiner, Grafenau (DE)

(73) Assignee: SLE Electronic GmbH (DE)

( * ) Notice: Subject to any disclaimer, the term of this patent is extended or adjusted under 35 U.S.C. 154(b) by 0 days.

(21) Appl. No.: 09/404,270

(22) Filed: Sep. 21, 1999

(30) Foreign Application Priority Data

Sep. 21, 1998 (DE) ..... 198 43 156

(51) Int. Cl.[7] ..... B21C 51/00; B21D 55/00

(52) U.S. Cl. ..... 72/21.4; 72/14.8; 72/15.1; 72/20.1; 72/712; 29/705; 29/753

(58) Field of Search ..... 72/20.1, 21.1, 72/21.4, 14.8, 15.1, 712; 29/705, 753, 863

(56) References Cited

U.S. PATENT DOCUMENTS

| | | | | |
|---|---|---|---|---|
| 4,914,602 A | | 4/1990 | Fumihiko et al. | |
| 5,101,651 A | * | 4/1992 | Yeomons | 72/21.4 |
| 5,195,042 A | | 3/1993 | Ferraro et al. | |
| 5,727,409 A | * | 3/1998 | Imove et al. | 72/21.1 |
| 5,887,469 A | * | 3/1999 | Maeda et al. | 72/20.1 |
| 5,937,505 A | * | 8/1999 | Strong et al. | 72/21.4 |
| 6,047,579 A | * | 4/2000 | Schmitz | 72/14.8 |
| 6,067,828 A | * | 5/2000 | Bucher et al. | 72/21.4 |

FOREIGN PATENT DOCUMENTS

| | | |
|---|---|---|
| AT | 190569 | 7/1957 |
| DE | 3842009 C1 | 3/1990 |
| DE | 4014221 A1 | 11/1990 |
| DE | 4038653 A1 | 6/1991 |
| DE | 4038658 A1 | 6/1991 |

* cited by examiner

*Primary Examiner*—Ed Tolan
(74) *Attorney, Agent, or Firm*—R W Becker & Associates; R W Becker

(57) ABSTRACT

The method for quality assurance of crimping connections made by a crimping device having an exchangeable tool with two tool parts uses a tool that is provided with an electronic data storage device. The electronic data storage device stores tool-specific nominal data derived from a nominal force-stroke characteristic line of a nominal crimping action of the tool. A crimp connector is fastened to the end of an electrical cable by placing the end of the electrical cable and the crimp connector between the two tool parts and moving the two tool parts relative to one another for carrying out the crimping action. The force-stroke characteristic line of the two tool parts is measured during the crimping action. The measured force-stroke characteristic line is compared to the stored nominal data.

4 Claims, 2 Drawing Sheets

METHOD FOR QUALITY ASSURANCE OF CRIMP CONNECTIONS PRODUCED BY A CRIMPING DEVICE AND CRIMPING TOOL AND CRIMPING DEVICE THEREFOR

BACKGROUND OF THE INVENTION

The present invention relates to a method for quality assurance of crimp connections produced by a crimping device wherein the crimp connections are produced by placing a crimp connector and an end of an electrical cable between two tool parts that are movable relative to one another and are components of a tool insertable into the crimping device. The quality of the crimp connection is monitored in that measured data, derived from a force-stroke characteristic line measured during the crimping action of the two movable tool parts, are compared to nominal data derived from a nominal force-stroke characteristic line.

The invention also relates to a crimping tool and a crimping device for performing the method.

The method of the aforementioned kind as well as a crimping device with a crimping tool of the aforementioned kind are known from German Patent Application 40 38 658 A1.

For the attachment of plugs to electrical cables with multiple cable wires in an insulating coating the so-called crimping process is usually employed. In a first step, the crimp connector embodied initially as a flat sheet metal part is formed about the cable end by moving two tool parts embodied as plungers relative to one another and is then safely contacted with the cable end. Especially cable harnesses in motor vehicles are comprised of a plurality of different electrical lines which must be provided by crimping with plugs or crimp connectors. The quality assurance of the crimping action is carried out, for example, such that during crimping the force-stroke characteristic line of the tool parts is recorded and directly compared to a nominal force-stroke characteristic line which is stored in the crimping device, or that based on the measured force-stroke characteristic line measured data are processed which are compared to stored nominal data. The nominal data, respectively, the nominal force-stroke characteristic line is determined upon startup of the tool.

In practice, there is the problem that a great number of different cables as well as different crimp connectors are used which require the use of different tools. These tools can be used in a common crimping device and are exchangeable. On the one hand, it is time-consuming and, on the other hand, it is expensive to determine and store after each tool exchange the nominal data which signalize perfect crimping.

It is therefore an object of the present invention to further develop the aforementioned method such that when operating the crimping device with different tools a perfect quality crimp connection can be achieved despite short tool exchange times. Furthermore, the invention has the object to provide a crimping tool of the aforementioned kind for performing the aforementioned method. Moreover, the invention has the object to provide a crimping device for use with such a tool.

SUMMARY OF THE INVENTION

The object is solved inventively by providing the tool with an electronic data storage device which stores therein tool-specific nominal data derived from the tool-specific force-stroke characteristic line, wherein these data are respectively compared to the measured data.

By providing the tool with a data storage device which stores tool-specific nominal data and by comparing these nominal data to the measured data, it is no longer required to determine nominal data by complex testing procedures upon tool exchange.

In a preferred embodiment, before removing the tool from the crimping device, data derived from the previously performed crimping processes are stored in the electronic data storage device of the tool.

Preferably, before removing the tool from the crimping device, the number of crimping processes performed during the previous tool use are stored on the data storage device of the tool.

The inventive crimping device comprises an exchangeable tool having an electronic data storage device and a data transmission device for bidirectional transmission of data between the data processing device and the data storage device. Sensors are provided for recording measuring parameters during a crimping process. A data processing device is provided for processing the output signals of the sensors into measured data and for comparing the measured data to nominal data. Upon first start-up of the tool nominal data are stored on the data storage device which nominal data are derived from the force-stroke characteristic line of a perfect crimping process. During the subsequent operation of the device, the measured data are compared to the nominal data stored in the data storage device for quality assurance purposes.

The crimping tool to be used in connection with the crimping device has an electronic data storage device for storing tool-specific data and also has a data transmission device for bidirectional data communication of data stored on the data storage device to and from an external data processing device.

BRIEF DESCRIPTION 0F THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 5.

Figure 1:
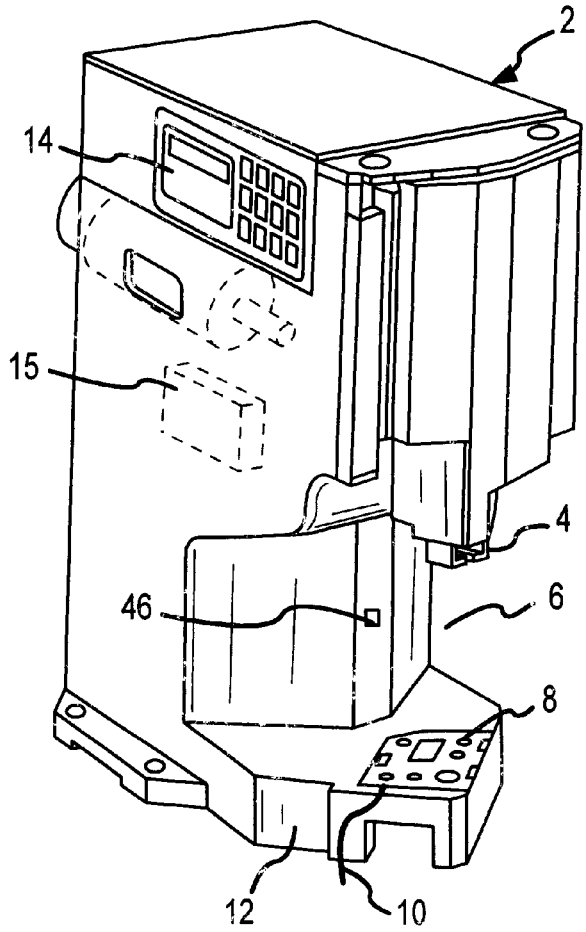
FIG. 1 shows a perspective representation of a crimping device with the tool being removed.

In the following description the FIGS. 1 and 2 correspond substantially to the device of the aforementioned German Patent Application 40 38 658 A1. Its disclosure is representative of a crimping device and a crimping method upon which the present invention is based.

The crimping device 2 is comprised of a crimping press in which a plunger is reciprocated by a non-represented drive in the vertical direction and ends in an adaptor 4. The adaptor 4 projects into the tool receiving space 6 which at its lower end has a plate 8 which is supported by a load cell (only line 10 extending to the load cell is shown) on the support 12 of the crimping device 2.

For operating the crimping device, a keypad 14 is provided that provides an interface to the data processing device 15 contained in the crimping device and comprising a microprocessor, a data storage device, and a program storage device.

Figure 2:
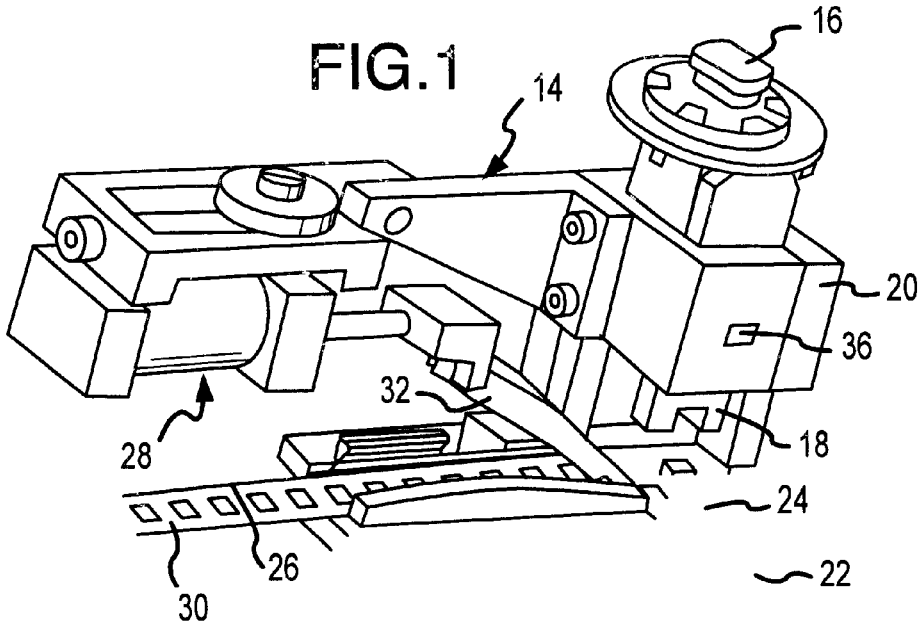
FIG. 2 shows a tool for use in the crimping device according to FIG. 1.

The tool 14 can be inserted into the tool receiving space 6 of the crimping device 2, whereby the tool is represented in detail in FIG. 2.

This tool comprises a connecting portion 16 connectable to the adaptor 4. The connecting portion 16 is rigidly connected to the tool part 18 forming the upper plunger and is movable in a reciprocating manner within the frame 20 together with the tool part 18.

The tool part 24 is positioned opposite the tool part 18 at the base body 22 which functions as the lower plunger or die.

For loading the tool with an initially flat sheet metal crimp connector 26, a feeding device 28 is provided which moves the strip 30 with the crimp connectors 26 by a movably driven lever 32 in a stepwise manner. When a crimp connector 26 is mounted on the lower tool part 24, an electric cable end having the insulation removed from the wires is placed between the tool parts 18 and 24 and is fixedly connected by crimping to the crimp connector 26.

Figure 3:
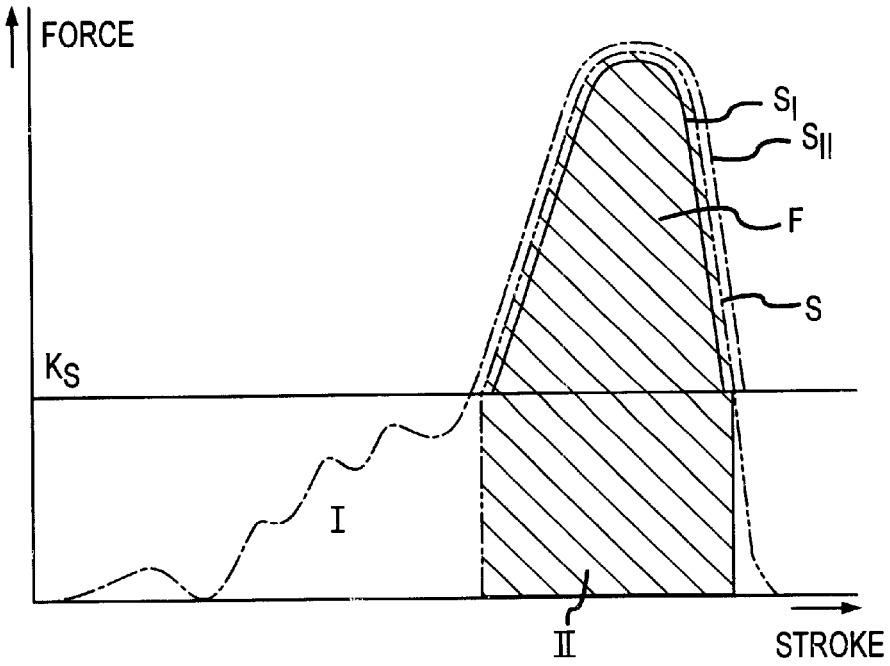
FIG. 3 shows a force-stroke characteristic line resulting from pressing of the tool parts against one another for producing a crimp connection.

During the crimping step the force-stroke characteristic line indicated in dashed lines in FIG. 3 is determined by measuring the force K applied to the tool by the adaptor 4 with the aid of the load cell sensor connected by line 10 to the adaptor 4 and by measuring the stroke that is performed by the adaptor 4 (a respective stroke sensor is not represented). This force-stroke characteristic line first represents the preparation phase I within which the upper tool part 18 comes to rest at the crimp connector 26 and the cable end. Subsequently, the actual crimping phase II is performed. The course of the curve is specific for a respective crimp connector and cable as well as the tool. The actual measured data evaluation is carried out above a threshold force $K_S$ for suppressing errors.

The dotted curve S is a nominal curve which represents a perfect crimping action. As nominal parameters for detecting a perfect crimping action, the curve S itself can be used or the integrated surface F of the curve S can be used which is a measure for the applied crimp work. The data reflecting the curve S and/or the surface F are stored as nominal data in the data processing device present within the crimping device 2.

During a crimping process the actual data are detected and compared to the nominal data. Upon deviation of the force-stroke characteristic line from the nominal curve in a downward direction ($S_I$) or in the upward direction ($S_{II}$) an error indication occurs. For detecting an erroneous crimping action, it is also possible to use other criteria such as too great a deviation of individual measuring points, additional measurements of the time period, etc.

Figure 4:
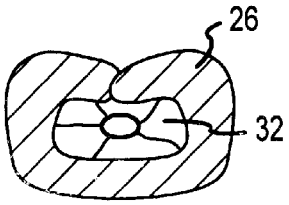
FIG. 4 shows a cross-section of a crimp connection.

FIG. 4 shows a cross-section of the electric cable provided with the crimp connector, the view showing the area of the wires without insulation. Shown is the crimp connector 26 bent into a sleeve shape and clamping the wires 32 of the cable for secure contacting in a positive-locking manner in its interior.

The afore described device and the disclosed method are known from German Patent Application 40 38 658 A1 and have therefore been described only in general terms.

As disclosed above, for different crimp connections different tools 14 must be used in the crimping device 2. According to the present invention, the tool 14 is provided with a data storage device 36 which in the represented example is connected to the frame 20. The object and function of this data storage device 36 is as follows.

When the tool 14 is inserted for the first time into the crimping device 2, the nominal data are determined, for example, with the aid of the nominal curve S and/or of the integral F by the data processing device 15 present in the crimping device and stored therein so that they are available as nominal data for future crimping processes. For this purpose, a crimp connection is, for example, tested with respect to mechanical stability, electrical resistance, and visual appearance, and the measured data of the crimp connection which was found to be perfect is stored as nominal data in the data processing device of the crimping device. Before the tool 14 is removed from the crimping device 2 in order to be replaced by another tool, the nominal data of the tool 14 are read out of the storage device of the data processing device 15 of the crimp device 2 and stored in the data storage device 36. In this manner, the tool 14 itself will carry its specific nominal data. Furthermore, upon removal of the tool 14 the number of crimping connections performed will be stored in the data storage device 36. When the tool 14 is now again ready for use, its nominal data can be read out of the data storage device 36 and can be stored in the storage device of the data processing device 15 of the crimping device 2 so that the nominal data are again available. Subsequently, the first crimping process is carried out at conventional velocity whereby it is possible to detect immediately whether this crimping process is performed properly or not.

The data storage device 36 and the data transmission between the data storage device 36 and the data processing device 15 of the crimping device 2 can be of various designs.

Figure 5:
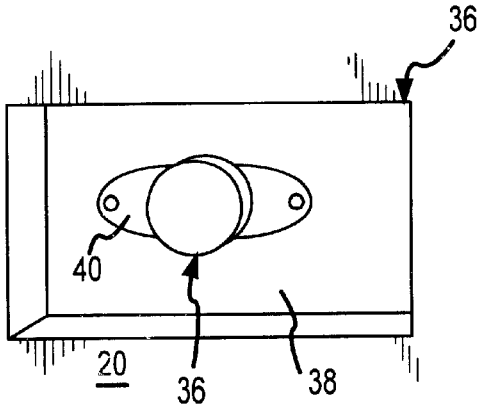
FIG. 5 shows a perspective view of a data storage device.

FIG. 5 shows an electronic data storage device 36 inserted into a recess 38 of the frame 20. The data storage device is comprised of a base plate 40 on which the actual electronic data carrier is mounted. The base plate 40 is fastened to the bottom of the recess 38. In this manner, the data storage device 36 is mounted in a protected manner at the frame 20.

The data storage device 36 can be a simple read/write storage device which comprises an interface that can be of the mechanically contacting type or can be of a contact-free design for reading data in and out of the storage device by a handheld reader. For more complex designs, the data storage device 36 can have a complete microprocessor with program storage device, data storage device, an input and output device, for example, with antenna and transponder.

The data processing device 15 of the crimping device 2 has a corresponding input and output device which transmits the data, for example, by a hand-held device.

In a convenient and reliable design the crimping device 2 has in the area of the tool receiving space 6 an interface 46 operating by contacting or contract-free. It is positioned opposite the interface provided at the backside of the tool at the frame 20 (see FIG. 3). An automatic data transfer can be performed via the interfaces upon insertion and start-up of the tool 14 and upon removal and shutdown of the tool 14. It is understood that in this case advantageously the entire data storage device 36 is arranged at the backside of the frame 20. It is further understood that different transmission techniques (contacting, contact-free, ultrasound, infrared, via antenna with sender, etc.) can be used. For radio transmission there are no spatial limitations with regard to the spatial arrangement of the data storage device and the input and output device of the data transmission device of the crimping device 2. Nominal data can be stored in the data storage device 36 of the tool 14 upon shutting down the tool 14 which can be, for example, the average values of a certain number of measured data. The tool can then be tested in a central tool managing system with the aid of these data and in comparison to original nominal data as well as optionally the number of crimping connections produced by the tool with regard to further proper function and service life.

It is understood that the invention can be used with different crimping devices or crimping presses and tools. For example, the circumference of a tool can be considerably smaller than that shown in FIG. 2. In special embodiments it is furthermore possible to exchange only the tool parts 18 and 24. In these cases, the respective tool part will support the data storage device.

Overall, the invention provides the possibility to monitor without time loss and in an extremely safe manner the quality of crimp connections produced with very different tools, wherein also the condition of the tools themselves can be detected and monitored. The tool-specific nominal data stored within the tool not only relate to the tool itself but also to the crimp connectors and the cable for which the tool is to be used. They depend only minimally or not at all on the respective crimp connection and can also, if needed, contain additional respective parameters. The invention can be used in any situation where multiple tools with tool-specific data are used in one or more devices in an exchangeable manner for the purpose of quality control or for controlling a device cooperating with the tool.

The specification incorporates by reference the disclosure of German priority document 198 43 156.2 of Sep. 21, 1998.

The present invention is, of course, in no way restricted to the specific disclosure of the specification and drawings, but also encompasses any modifications within the scope of the appended claims.

What is claimed is:

1. A method for quality assurance of crimping connections made by a crimping device having an exchangeable tool comprised of two tool parts; said method comprising the steps of:

providing the tool with an electronic data storage device;

storing tool-specific nominal data derived from a nominal force-stroke characteristic line of a nominal crimping action of the tool in the electronic data storage device after each tool exchange;

fastening a crimp connector to an end of an electrical cable by placing the end of the electrical cable and the crimp connector between two tool parts and moving the two tool parts relative to one another for carrying out the crimping action;

measuring a force-stroke characteristic line of the two tool parts during the crimping action; and comparing the measured force-stroke characteristic line to the stored nominal data.

2. A method according to claim 1 further comprising the step of storing data derived from the crimping actions performed by the tool during the previous crimping session in the electronic data storage medium before removing the tool from the crimping device.

3. A method according to claim 2, wherein the data include the number of crimping actions performed by the tool during the previous crimping session.

4. A crimping device comprising:

an exchangeable tool having an electronic data storage device;

wherein nominal data, derived form a force-stroke characteristic line of a nominal crimping action, are stored in said electronic storage device before said crimping device is first operated;

sensors for measuring parameters during a crimping action;

a data processing device for processing the output signals of said sensors into measured data of said parameters and for comparing the measured data to said nominal data stored in said electronic storage device;

a bidirectional data transmission device for transmitting data between said data processing device and said data storage device.

* * * * *